United States Patent [19]

Magai

[11] 4,358,710

[45] Nov. 9, 1982

[54] FLUORESCENT LIGHT UNIT WITH DIMMABLE LIGHT LEVEL

[75] Inventor: Donald E. Magai, Cleveland Heights, Ohio

[73] Assignee: General Electric Company, Schenectady, N.Y.

[21] Appl. No.: 218,020

[22] Filed: Dec. 19, 1980

[51] Int. Cl.[3] ..... H05B 41/18

[52] U.S. Cl. ..... 315/101; 315/100; 315/53; 315/58; 315/199; 315/291; 315/DIG. 4

[58] Field of Search ..... 315/53, 58, 62, 99–101, 315/106, 194, 199, 200 R, 291, 309, DIG. 4, DIG. 5, DIG. 7

[56] References Cited

U.S. PATENT DOCUMENTS

| | | | |
|---|---|---|---|
| 2,320,424 | 6/1943 | Gates | 315/100 |
| 2,350,462 | 6/1944 | Johns | 362/216 |
| 2,652,483 | 9/1953 | Laidig et al. | 362/216 |
| 2,817,004 | 12/1957 | Baumgartner et al. | 362/216 |
| 3,249,807 | 5/1966 | Nuckolls | 315/199 |
| 3,500,124 | 3/1970 | Babcock | 315/194 X |
| 3,836,814 | 9/1974 | Rodriquez | 315/51 |
| 3,878,431 | 4/1975 | Petrina | 315/199 X |
| 4,178,535 | 12/1979 | Miller | 315/53 |
| 4,270,071 | 5/1981 | Morton | 315/62 |
| 4,284,925 | 8/1981 | Bessone et al. | 315/53 X |

*Primary Examiner*—Eugene R. La Roche

*Attorney, Agent, or Firm*—Norman C. Fulmer; Philip L. Schlamp; Fred Jacob

[57] ABSTRACT

A screw-in fluorescent light unit having high and low light levels, for use in a 3-way socket. A reactor ballasts the lamp for high light output, and a variable dimming circuit is added to ballast the lamp for variable low light output.

6 Claims, 3 Drawing Figures

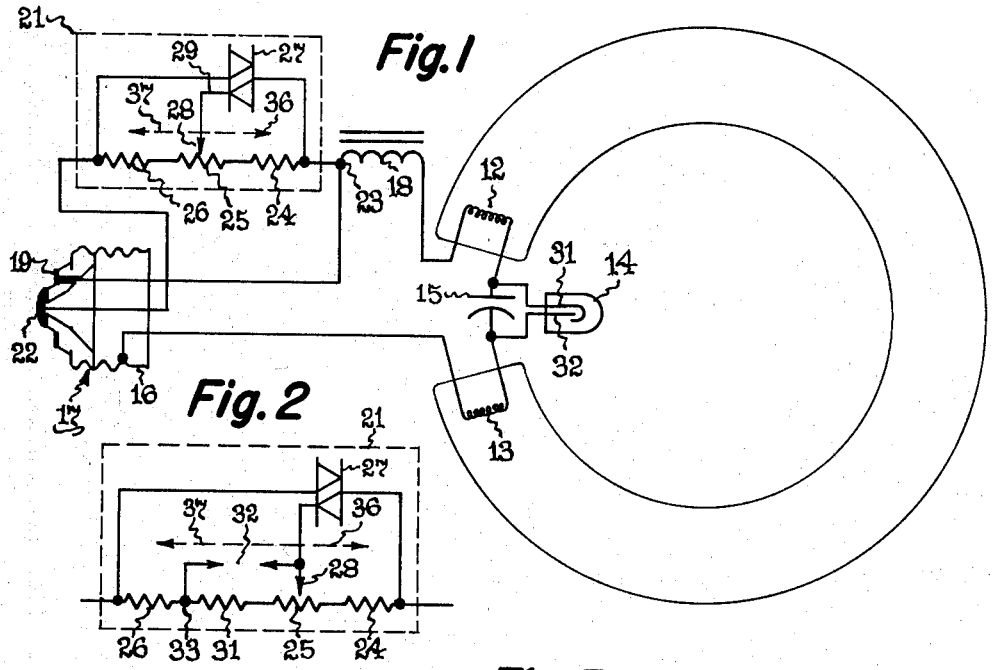
Fig. 1
21
29
27
37
28
36
26
25
24
23
18
12
31
14
15
32
13
19
22
17
16
Fig. 2
21
27
37
32
36
28
26
33
31
25
24
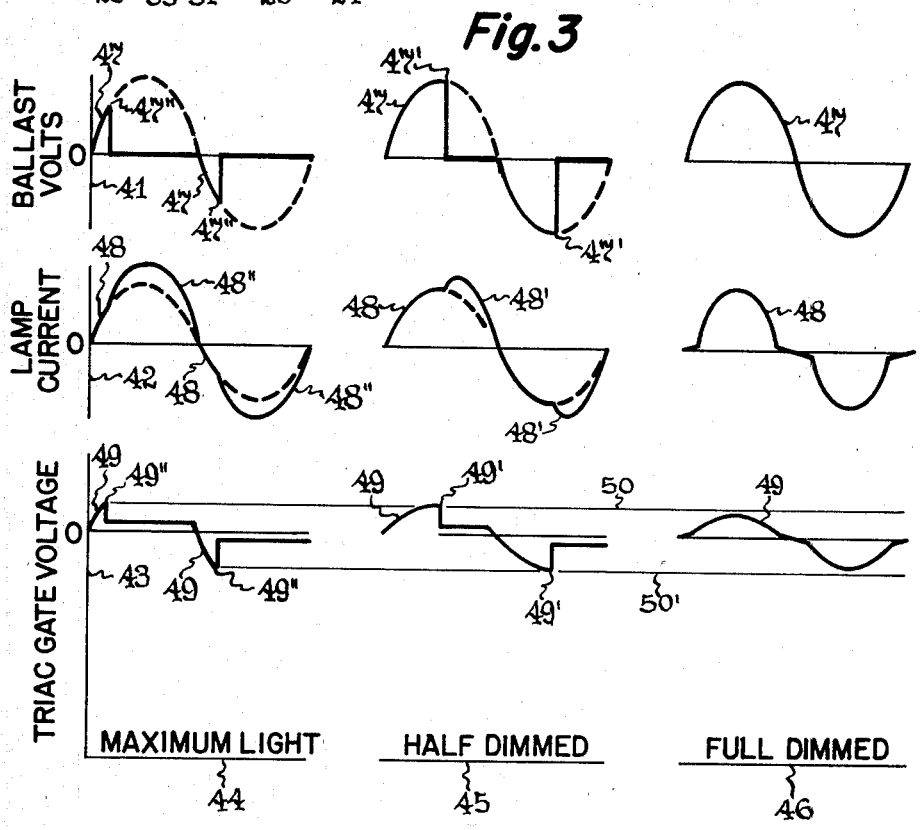
Fig. 3
BALLAST VOLTS
LAMP CURRENT
TRIAC GATE VOLTAGE
MAXIMUM LIGHT
HALF DIMMED
FULL DIMMED
44
45
46

FLUORESCENT LIGHT UNIT WITH DIMMABLE LIGHT LEVEL

CROSS-REFERENCES TO RELATED APPLICATIONS

Ser. No. 218,042, Charles E. Beck, "Fluorescent Light Unit with Dual Light Levels", filed concurrently herewith and assigned the same as this invention.

Ser. No. 218,043, Donald E. Magai, "Fluorescent Light Unit with Dual Light Levels", filed concurrently herewith and assigned the same as this invention.

Ser. No. 47,985, Rudolph Metoff, "Circular Fluorescent Lamp Unit", filed June 13, 1979 and assigned the same as this invention.

BACKGROUND OF THE INVENTION

The invention is in the field of light units, such as screw-in circular fluorescent lights, and light units having selectable light levels such as bright and dim, or variable dimming.

Three-way incandescent light bulbs have been popular for many years, for use in situations where differing light levels are desirable under differing conditions, and to conserve electrical power consumption by adjusting the light level to the lowest value suitable for the needed visual task. Fluorescent lamp units are more electrically efficient than incandescent lamps, and ways have been proposed for providing multiple-light level fluorescent lamp units. For example, U.S. Pat. Nos. 2,350,462 to Johns, 2,652,483 to Laidig, and 4,178,535 to Miller, disclose ways of providing selectably different light levels for circular fluorescent lights by inserting different reactive ballast elements, or different transformer winding turns, in series with the lamp bulbs. The general idea of a screw-in ballasted fluorescent lamp unit has been known, for example, by the disclosure in U.S. Pat. Nos. 2,320,424 to Gates and 2,817,004 to Baumgartner. U.S. Pat. Nos. 3,249,807 to Nuckolls and 3,500,124 to Babcock disclose variable brightness lamp devices having phase-controlled switching circuits.

SUMMARY OF THE INVENTION

Objects of the invention are to provide a feasible and low-cost multiple light level fluorescent lamp unit having variable dimming.

The invention comprises, briefly and in a preferred embodiment, a fluorescent light unit having a fluorescent lamp bulb (such as a circular type), a starter switch connected between the bulb's cathodes, a reactor ballast selectively connected in series with the lamp bulb for high-level light output, and a variable light level dimming circuit connected in series with the reactor to provide variable low-level light output, and including a bilateral switch device connected so as to be capable of intermittent conduction during lamp starting at low level, and variably phase-controlled conductive during normal lamp operation at low-level light setting.

BRIEF DESCRIPTION OF THE DRAWING

FIG. 1 is an electrical diagram of a preferred embodiment of the invention.

FIG. 2 shows an alternative embodiment of a portion of FIG. 1.

FIG. 3 is a graphical plot of voltage and current in the circuit during operation of the light unit at low light level.

DESCRIPTION OF THE PREFERRED EMBODIMENTS

As shown in FIG. 1, a fluorescent light bulb 11, preferably of a circular type known as Circline, is provided with cathodes 12 and 13 within the bulb and near the ends thereof. A conventional glow-starter switch 14 is connected between an end of each of the cathodes 12 and 13. The remaining end of cathode 13 is electrically connected to the threaded shell 16 of a conventional three-way lamp screw-base 17. The remaining end of cathode 12 is connected via a ballast reactor 18 to the ring terminal 19 of the base 17. The reactor 18 has a value to cause "high-level" light output to be produced by the bulb 11 when electrical power is applied, via a conventional three-way lamp socket, to the shell 16 and ring terminal 19 of base 17. A "low level" light circuit 21 is connected between the center "button" terminal 22 of the base 17 and the end 23 of reactor 18 which is connected to the ring terminal 19. In FIG. 1, the low-light level circuit 21 comprises ballast resistors 24, 25, and 26 connected in series between the center base terminal 22 and the reactor end 23, and also comprises a bilateral diode switch 27, such as a triac, connected in parallel with the resistors 24, 25, and 26. The resistor 25 has a variable tap 28 connected to the gate electrode 29 of the bilateral switch 27. In the FIG. 2 alternative low-level ballast, an additional resistor 31 is connected between the resistors 25, 26, and a switch connection 32 is provided to connect the variable tap 28 to the junction 33 of resistors 26, 31 to prevent a potential instability of lamp operation, as will be described. The low light level circuit 21 may be placed in the central hub of the light unit disclosed in the above-referenced Metoff patent application, along with the reactor 18, the 3-way base 17 being attached to the end of the hub. The lamp 11, starter switch 14, and reactor 18 may be the same as disclosed in Metoff.

When the screw base 17 is inserted in a conventional three-way socket the shell 16 is connected to one side of the a.c. electrical power. When the socket switch is in the "off" position, no power is applied to either the ring terminal 19 nor the center terminal 22, and no light is produced. When the socket switch is turned to its next (first) position, electrical power is provided to the ring terminal 19 (and to the low-light filament of a conventional incandescent 3-way bulb). In the next (second) switch position, power is applied to the center terminal 22 (and to a second and brighter filament of a conventional 3-way bulb, for "medium" light). The third switch position connects electrical power to both the ring terminal 19 and the center terminal 22 (so that both filaments of a 3-way incandescent bulb light up resulting in "high" light level). The next socket switch position is again "off".

When a two-level light system is connected to a three-way lamp socket, as in the present invention, there is a choice available in light-level sequence. As shown and disclosed herein, the light-level sequence of light bulb 11 is "off-high-low-high-off", because the first socket switch position activates the ring contact 19 and operates the bulb 11 on "high" via reactor 18; the second socket switch position activates the center terminal 22 and operates the bulb 11 on "low" via the series-connected reactor 18 and resistors 24, 25, 26, etc.; and the third socket switch position activates both the ring terminal 19 and center terminal 22, again operating the bulb 11 on "high" via the reactor 18 (the "low"

impedance 21 being shorted out between terminal 19 and 22); the next switch position is again "off". This light level sequence is preferred by many people because the light level changes at each switch position and thus something is seen to change in light level, indicating proper functioning. Alternatively, if the wiring connections were interchanged at the base terminals 19 and 22, the light-level sequence would be "off-low-high-high-off", and some people might suspect something wrong with no change in light level between the second and third switch positions.

The lamp unit, in each of its "high" and "low" light levels, functions in two sequential conditions: starting and operating. When the unit is turned on at "high" light level, via a-c voltage applied across the shell 16 and the ring terminal 19, voltage is applied to the lamp bulb cathodes 12, 13, and across the glow-starter switch 14, which causes gas (such as argon or neon) in the switch 14 to glow, and the heat thereof causes one or both of bimetal contacts 31, 32 to close together, causing current to flow through and heat the cathodes 12, 13 to electron-emitting temperature. While the bimetal starting switch contacts 31, 32 are thus closed, the gas ceases to glow and the contacts cool and open apart in about a second, causing an inductive voltage "kick" to occur in the reactor 18 which causes the heated cathodes 12, 13 to emit electons and start an electrical discharge in the gas (mercury, and argon or other starting gas) in the bulb which excites the phosphor on the inner bulb wall and generates visible light.

Starting the lamp 11 in the high-level condition with the reactor 18 in series with the bulb 11 as just described, is conventional and no problem. However, starting the bulb 11 in the low-level condition with the resistor 24 (or another additional impedance such as an inductor or a capacitor) in the circuit, can cause problems in reliable starting of the lamp 11 due to insufficient pre-heating current in the cathodes 12, 13 to bring their heat up to sufficient value to ensure electronemissive discharge starting in the lamp when the starting switch 14 opens to induce lamp starting. Also, insufficient preheating of the cathodes at the instant of lamp starting (assuming the lamp starts) can cause electrons to be "pulled" from the cathodes's electron emissive material by the starting voltage electrical field, thus damaging the electron emissive material.

The above-referenced Magai patent application discloses and claims a dual light-level lamp unit in which a bilateral switch 27 is connected across a low-light level ballast resistor 24 and its gate electrode 29 is connected to a fixed tap on the resistor 24, so that during lamp starting at low level and while the starter switch 14 is closed (for about one second), the bilaterial switch 27 becomes conductive during each half-cycle of preheat current in the cathodes 12, 13, thus increasing the cathode preheat current to a value (which is greater than it would be if limited by the resistor 24) sufficient to preheat the cathodes to a temperature for proper starting of the lamp 11 when the starter switch 14 opens; thereafter the bilateral switch does not become conductive during lamp operation at low level. Curves of circuit voltage and current are shown for both the starting and operating conditions.

In accordance with the present invention, the bilateral switch 27 functions to facilitate lamp starting, in the manner just described, and also functions to provide adjustable variable light level in the "low" light setting, which is ballasted by the circuit 21. When the adjustable tap 28 of resistor 25 is moved in the direction indicated by the arrow 36, the lamp 11 becomes relatively brighter, and when tap 28 is moved in the other direction indicated by the arrow 37, the lamp 11 becomes relatively dimmer.

FIG. 3 illustrates the circuit functioning which provides variable dimming in the low light level condition. The curves show ballast volts 41 (across low-level ballast 21), lamp current 42, and triac gate volts 43, in the three typical conditions of maximum light 44, half dimmed 45, and full dimmed 46. The full dimmed condition 46 is the same as the "low" light level of the above-referenced Magai application; i.e., the triac switch 27 does not conduct and low-level biasing is provided entirely by the resistance of the ballast 21. Therefore the ballast voltage curve 47, lamp current curve 48, and triac gate voltage curve 49 are sine waves, the latter two curves having slight irregularities at the zero crossovers due to a slight starting delay of the lamp's discharge each half cycle. The triac 27 does not conduct because its gate voltage does not reach the conduction positive and negative values 50, 50'. In the half-dimmed condition 45, with the variable tap 28 set at about the center of resistor 25, the triac 27 becomes conductive at about the 90° phase angle point 47' of each half cycle, thus lowering the ballast 21 impedance to near zero and producing a "hump" 48' of increased lamp current during the last half of each half cycle, thus increasing the light output of lamp 11. The "hump" 48 of increased current contains frequency components higher than 60 Hz and for which the reactor 18 has a relatively greater impedance and therefore the "half dimmed" brightness is not as great as would otherwise be expected; however, the tap 28 can be moved in the direction 36 to a position for causing true half-dimming. The conduction of triac 27 in the half dimmed condition is caused by its gate voltage 49 rising to the conduction voltage values 50,50' at the point 49' during each half cycle of operation.

In the maximum light condition 44, with the bias resistor tap 48 moved all the way in direction 36, the triac gate voltage 49 reaches the triac conduction voltage levels 50,50' early during each half cycle, at points 49'', causing the ballast voltage drop to reduce to near zero at point 47'', producing relatively large and broad lamp current "humps" 48'' during each half cycle whereby the lamp brightness is nearly as great when in the "high" condition as ballasted by reactor 18.

When the circuit 21 is adjusted toward the full dimmed condition 46, so that the triac gate voltage curve 49 has a maximum peak value at or near the triac conduction voltage levels 50,50', an instability can occur, because, due to fluctuations in power line voltage and in the gas discharge of lamp 11, the peak of the gate voltage 49 will fluctuate above and below the levels 50 and 50', causing the triac 27 to intermittently conduct which causes an annoying flickering of the lamp 11. This is overcome by the addition of resistor 31 and switch 32 to the low-level ballast 21, as shown in FIG. 2, which are arranged so that as the variable tap 28 is moved toward the dimming direction 37 and the triac gate voltage 49 is decreasing to a peak value slightly greater than the gating voltage levels 50 and 50', the switch 32 closes and shorts out the resistor 31, causing the peak of gate voltage 49 to decrease to a peak value lower than the voltage levels 50 and 50', thus providing a discontinuity in the gate control voltage at the levels 50,50' and preventing the above-described instability.

The invention has been found to achieve its objectives of providing a feasible low-cost multiple light level fluorescent lamp unit, having variable dimming in the low light level condition, and such a lamp unit in which both the high-light level circuit and the low-light level circuit can be provided in the central ballast hub unit disclosed in the above-referenced Metoff patent application.

While preferred embodiments and modifications of the invention have been shown and described, various other embodiments and modifications thereof will become apparent to persons skilled in the art and will fall within the scope of the invention as defined in the following claims.

I claim:

1. A multiple light level gas discharge light unit, such as a fluorescent light unit, for operation from a-c electrical power, comprising a gas discharge light bulb having a pair of cathodes therein, a three-terminal base, means connecting a first end of one of said cathodes to a first terminal of said base, a ballast reactor connected between a first end of the other of said cathodes and a second terminal of said base and adapted to ballast said light bulb at a relatively high light level, and ballast circuit means connected between said second terminal and a third terminal of said base and adapted to ballast said light bulb at a relatively low light level in cooperation with said ballast reactor, said ballast circuit means comprising an impedance connected between said second and third base terminals, and bilateral switch means connected in parallel with said impedance, and said light unit including a starter switch connected between the remaining ends of said cathodes and adapted to close for a period of time when electrical power is applied to said base, in order to cause preheat current to flow through said cathodes, and thereafter be in open condition when said light bulb is operating, said bilateral switch means being adapted to be conductive during at least a portion of each electrical power half-cycle during said preheating of the cathodes for said relatively low light level operation, and control means connected to control the conduction phase angle of said bilateral switch means to vary the light level of said relatively low light level operation.

2. A light unit as claimed in claim 1, in which said bilateral switch means includes a gate electrode, and in which said control means comprises a resistor connected in series with said impedance and having a variable tap connected to said gate electrode.

3. A light unit as claimed in claim 2, in which said impedance is a resistor.

4. A light unit as claimed in claim 1, in which said control means controls the conduction phase angle of said bilateral switch means from early conduction during each half cycle, to no conduction.

5. A light unit as claimed in claim 4, in which said bilateral switch means includes a gate electrode, and in which said control means applies a control voltage to said gate electrode which is variable from above to below the conduction threshold level of the bilateral switch means, and means providing a discontinuity in said control voltage to prevent it from having a value equal to said threshold level.

6. A light unit as claimed in claim 5, in which said control means comprises a control resistor connected in series with said impedance and having a variable tap connected to said gate electrode, and in which said means providing a discontinuity in the control voltage comprises an additional resistor having an end connected to said control resistor, and a switch for electrically connecting said variable tap to the other end of said additional resistor when said tap is moved to a point near said additional resistor.

* * * * *